US005086675A

United States Patent [19]

Leung et al.

[11] Patent Number: 5,086,675

[45] Date of Patent: Feb. 11, 1992

[54] CORKSCREW

[76] Inventors: Tai L. Leung, 7A Oxford Court, 26 Braemar Hill Road, North Point; Tai T. Leung, Flat D, 3/F., 3 Cheung Sha Wan Rd., Kowloon, both of Hong Kong

[21] Appl. No.: 568,176

[22] Filed: Aug. 16, 1990

[51] Int. Cl.[5] ..... B67B 7/04

[52] U.S. Cl. ..... 81/3.29; 81/3.45

[58] Field of Search ..... 81/3.29, 3.07, 3.36, 81/3.45, 3.35

[56] References Cited

U.S. PATENT DOCUMENTS 2,342,156 2/1944 Miller ..... 81/3.29

2,522,219 9/1950 Gaeta ..... 81/3.29

FOREIGN PATENT DOCUMENTS 2027681B 1/1983 United Kingdom .

*Primary Examiner*—Roscoe V. Parker

*Attorney, Agent, or Firm*—Dick and Harris

[57] ABSTRACT

The corkscrew comprises a housing (12) in which is screw-engaged a barrel (14). The barrel has an internal screw thread (56), of opposite hand to its outer thread (52), engaged with the housing, and a drive member (16), carrying a screw (24), and a handle (22) has a projection (58) engaged in the internal screw thread. The bottom of the barrel has a cork engaging portion (66) for gripping the top of a cork when the housing is seated on the neck of a bottle with the screw piercing the cork. The handle (22) is rotatable in one direction to drive the screw into the cork. The projection (58) moves down the internal thread (56) and engages a stop (72) so that continued rotation raises the barrel with the drive member to draw the cork into the housing. On reverse rotation of the handle, the projection moves up the internal thread to withdraw the screw such that the cork is pushed out and released from the screw by the cork engaging portion (66). The projection engages a stop (74) so that further reverse rotation returns the barrel to the initial position.

12 Claims, 3 Drawing Sheets

CORKSCREW

BACKGROUND OF THE INVENTION

The present invention relates in general to a corkscrew and in particular to a corkscrew adapted to pierce into a cork and extract it from a bottle by way of a single corkscrew motion.

Corkscrews are known in the prior art. A conventional type of corkscrew comprises an elongated metal screw and a transverse handle connected to one end of the screw. One disadvantage of this kind of corkscrew is that no support means or abutment means is provided on the corkscrew to position same against a bottle. Another disadvantage is that the screw is not covered by any means whatsoever rendering the corkscrew rather unsafe to use. Furthermore, even if the screw is safely and correctly driven into a cork, extracting the cork from the bottle is a difficult task. It requires a user to exercise a considerable amount of force on the handle in order to pull the cork out from the bottle.

Another type of corkscrew consists basically of a brace, a leverage assembly operatively associated with the brace and a screw connected to the leverage assembly. Operation of this type of corkscrew involves pulling the lever by one hand, or, some cases, both hands. In the case where two hands are required to manipulate the lever, the bottle is left unsecured giving rise to a hazardous situation where the bottle may be out of balance. In the case where only one hand is needed to operate the lever sparing the other hand to hold the bottle in position, operation of this kind of corkscrew involves quite a number of steps. It takes skill to operate and, as such, an infrequent user may find it troublesome, if not difficult to use.

GB-2027681B discloses a corkscrew comprising a housing, engageable over the neck of a bottle, and a member, like a conventional type corkscrew, comprising a screw with a transverse handle. The member is axially slidably engageable in a sleeve in the housing as the screw penetrates a cork by rotation of the handle. The handle and the housing have abutment surfaces which limit the axial movement, so that continued rotation in the same direction causes the cork to ride up the screw into the housing.

In order to remove the cork from the screw, the housing is made flexible for the cork to be gripped by squeezing the housing while the handle is rotated.

This construction has several disadvantages. The housing and the screw are separable, so that one of the parts may be lost or displaced and the screw is exposed, so that there is risk of injury. Removal of the cork from the screw is not easy, since a tight grip of the cork through the housing is necessitated.

The present invention overcomes the problems experienced in the prior art.

SUMMARY OF THE INVENTION

According to the present invention, there is provided a corkscrew comprising a housing having means for locating the housing over the mouth of a corked bottle, as crew member having a handle outside the housing and a screw within the housing, whereby rotation of the member in a first direction drives the screw into the cork in the bottle and the member axially into the housing, and first limiting means limiting said axial movement whereby continued rotation of the member in said first direction drives the cork into the housing and out of the bottle, wherein a barrel is screw-engaged in the housing and the limiting means is between the barrel and the member so that the cork is driven into the housing by axial movement of the barrel relative to the housing, means is provided in the housing for engaging the end of the cork, whereby rotation of the member in a second direction, opposite to the first direction, releases, or almost releases the screw from the cork with axial movement of the member relative to the barrel and the housing, and second limiting means between the barrel and the member whereby continued rotation of the member in said second direction effects return axial movement of the barrel relative to the housing.

A specific embodiment of the invention will now be described with reference to the accompanying drawings wherein:

FIG. 1 is a general longitudinal sectional view of a corkscrew according to the invention, depicting the corkscrew in a ready-to-operate position, FIG. 2 is an elevation of an end of a barrel of the corkscrew, in the direction of arrow II in FIG. 1, FIG. 3 is a longitudinal sectional view similar to that in FIG. 1, showing a screw of the corkscrew of the driven into a cork, with an actuation rod driven in a downward position relative to the barrel and a housing, and FIG. 4 is a longitudinal sectional view similar to that in FIG. 3, showing the barrel driven upward relative to the housing with the cork drawn from a bottle and into the housing.

DETAILED DESCRIPTION OF THE DRAWINGS

Figure 1:
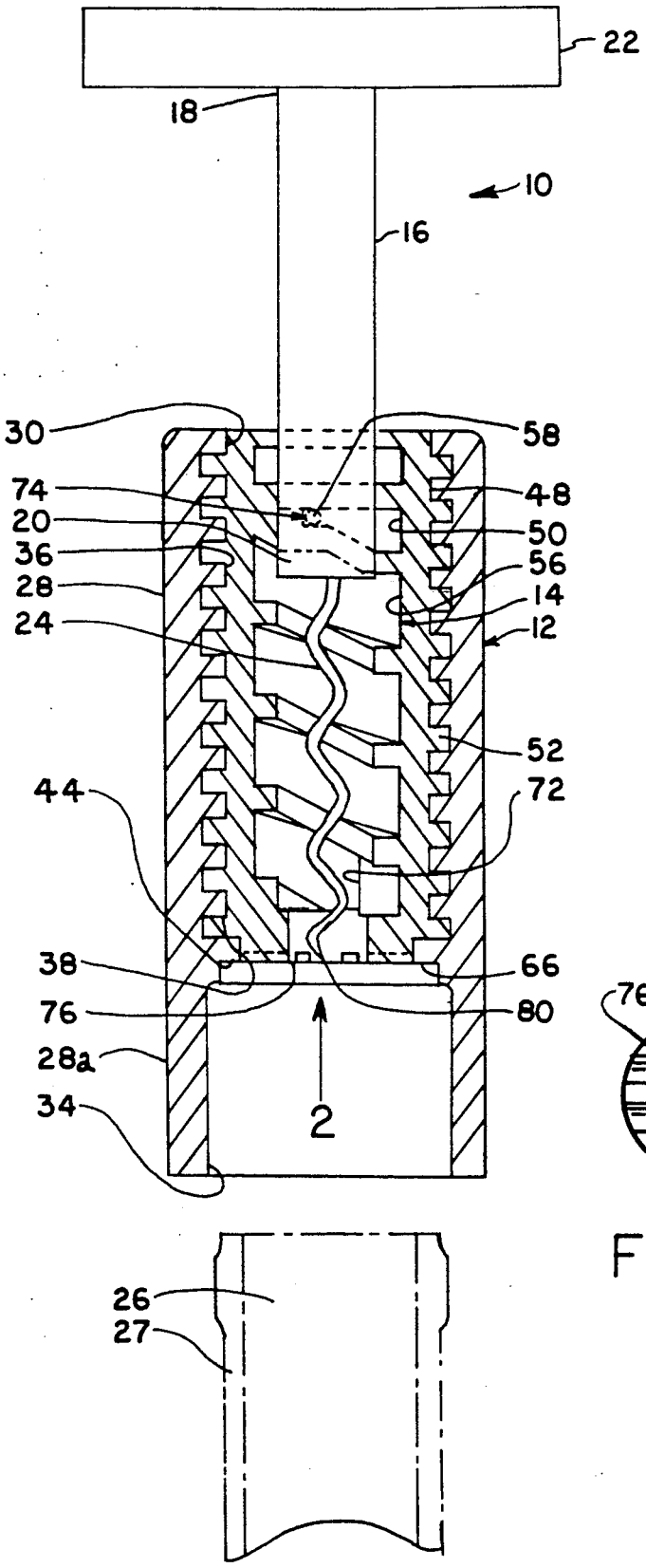

Referring now to the drawings, in which like reference numerals represent like parts throughout the several views, FIG. 1 shows a corkscrew designated generally by reference numeral 10. The corkscrew 10 consists mainly of a case or housing 12, a tubular element or barrel 14 and an actuation rod member 16.

The actuation rod member 16 is positioned axially through the barrel 14 and is engaged to the barrel 14 by way of means which will be described in detail later. The actuation rod member 16 has a first end 18 and a second end 20. Provided integrally at the first end 18 of the actuation rod member 16 is a handle 22. This handle 22 is, according to the preferred embodiment, in the form of a bar member disposed perpendicular to the actuation rod member 16. The handle 22 may be of other appropriate shape or configuration. Provided at the second end 20 of the actuation rod member 16 is a screw 24 which is adapted to pierce into a cork 26 to be removed from an opening end of a bottle 27.

The actuation rod member 16, having a circular cross sectional configuration, is in operative relation to the barrel 14 which is in turn in operative relation to the housing 12. The housing 12, is a hollow cylinder having a gripping portion **28*a* in its outer wall 28, to be gripped by a hand. The outer wall 28 of the housing 12** may be of different shape, e.g. frusto-conical.

It is contemplated that the diameter of the actuation rod member 16 is slightly less than the diameter of the inner bore of the barrel 14 thus enabling the actuation rod member 16 to be smoothly received and rotatable therein. Similarly, the outer diameter of the barrel 14 is slightly less than that of the inner bore of the housing 12 such that the barrel 154 can be rotated therein in a smoother manner.

The housing 12 has a generally cylindrical inner wall 30 defining an inner bore therein. An enlarged diameter portion 34 is formed at an axial end of the housing 12 defining an open end of the corkscrew 10 for receiving therein the neck of the bottle 27.

The inner wall 30 is provided with threaded portion 36, which in the preferred embodiment is substantially along the whole length of the inner wall 30, except for the enlarged diameter portion 34 and a portion contiguous thereto.

Provided integrally on the inner wall 30 of the housing 12 adjacent the enlarged diameter portion 34 thereof is an annular collar portion 38 having an inner diameter substantially larger than the major diameter of a cork 26. The lower wall 44 of the collar portion 38 facing the open end of the corkscrew 10 serves as an abutment means against which the open end of the bottle neck may abut during the cork extracting operation.

Figure 4:
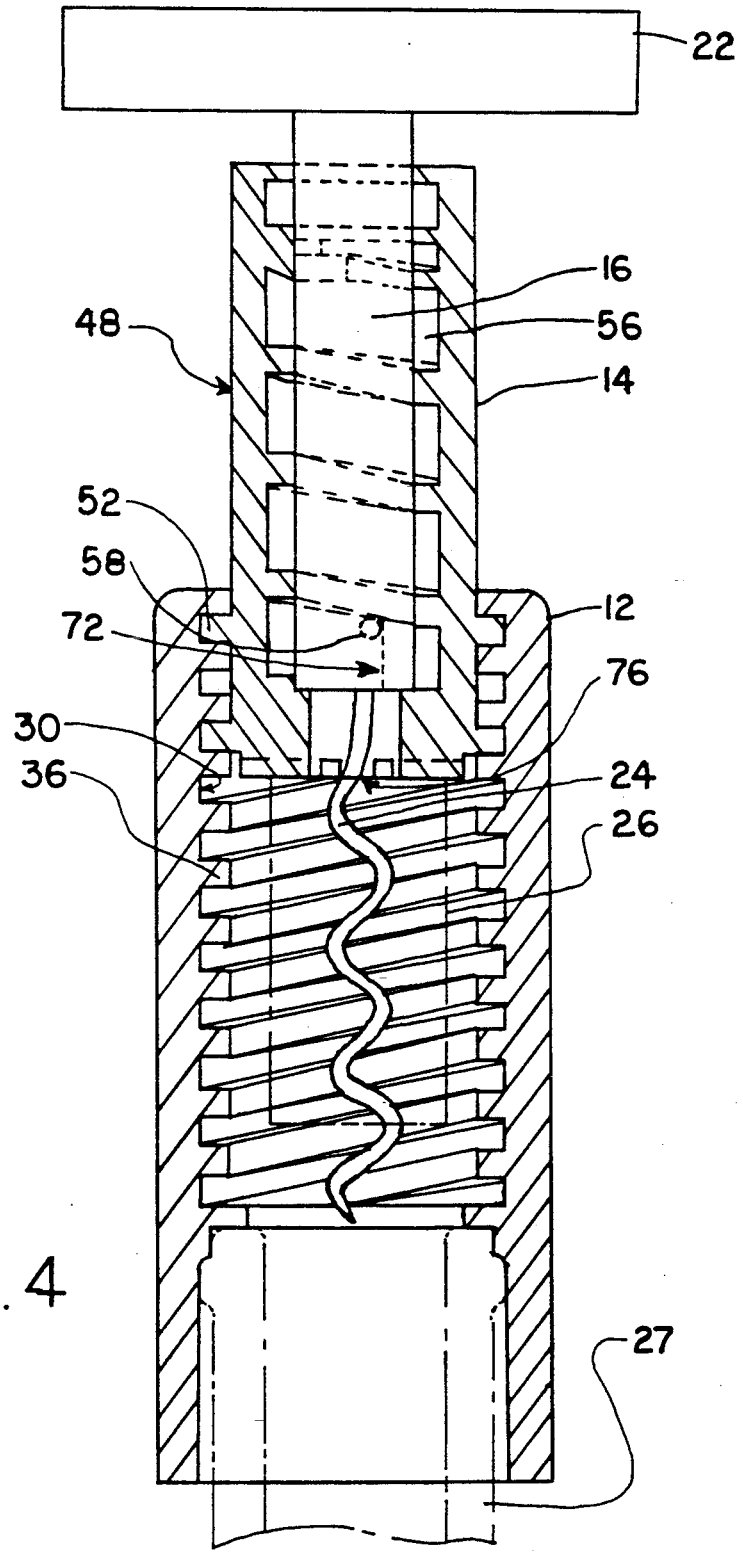

Coaxially positioned within the housing 12 is the barrel 14, which is a tubular member having a cylindrical out wall 48 and a cylindrical inner wall 50. A first threaded portion 52 is provided on the outer wall 48 at a lower end thereof for threadable engagement with the threaded portion 36 of the housing 12. The threaded portions terminate in end walls (not shown) which define limit stops to limit axial movement of the barrel in the housing between upper and lower and limit positions. The lower limit position is shown in FIG. 1 with the barrel accommodated in the housing, and the upper limit position is shown in FIG. 4, with the barrel projecting from the housing. Both the threads of the threaded portion 36 of the housing and the threaded portion 52 of the barrel are, accordingly to the present embodiment, left-handed two-start threads. A helically grooved track 56 is provided by the inner wall 50 of the barrel 14, this track being of opposite hand to the threaded portion 52 of the barrel 14. Although it is shown in the preferred embodiment that the threads are square threads, it is appreciated that the threads may be in the form of other shapes, such as trapezoidal threads or triangular threads. Furthermore, the threads may be single-start threads.

Figure 3:
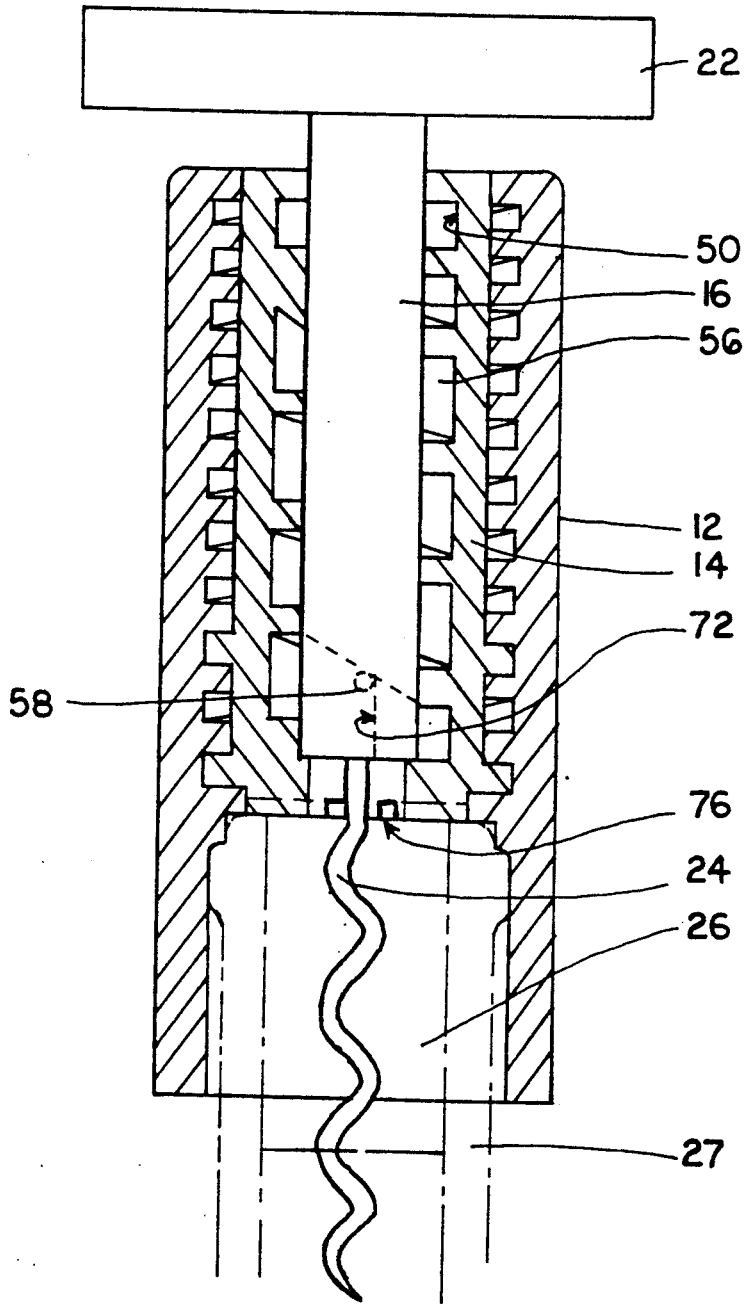

The structure and arrangement of the actuation rod member 16 will now be described. The actuation rod member 16 is disposed axially through an inner bore defined by the inner wall 50 of the barrel 14 and is adapted to be rotatable coaxially with the barrel 14. The actuation rod member 16 is preferably made of plastic material of rigid structure and has a projection 58, serving as a driving peg, which extends radially outwardly from the actuation rod member 16 at a position adjacent the end 20 remote from the handle. This projection 58 preferably has a cylindrical configuration. The projection 58 may be integral with the actuation rod member 16, or attached thereto. The projection 58 is movable along the track 56 between upper and lower limit positions. The track has upper and lower abutment surfaces 74, 72, which limit movement of the projection. The upper limit position is shown in FIG. 1, from which anti-clockwise rotation of the handle 16 is prevented by the barrel being at its lower limit position in the housing 12. The lower limit position of the projection is shown in FIG. 3, from which clockwise rotation of the handle 16 causes accompanying movement of the barrel 14 in the housing 12 towards the upper limit position of the barrel, as shown in FIG. 4.

The handle 22 is, according to the preferred embodiment, in the form of a bar member disposed transversely to the actuation rod member 16. Extending from the other end of the rod member 16 is the screw 24 most preferably made of metal. The screw 24 is adapted to screw into the cork 26 and remove same from the neck of a bottle.

Figure 2:
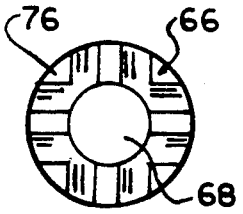

According to the preferred embodiment, the lower end of the barrel 14 is substantially closed by an integral cork-engaging portion 66 provided with integral projections 76. This portion has an aperture 68 (FIG. 2), for permitting passage of the screw therethrough.

Operation of the corkscrew 10 will now be described in detail.

In the ready-to-operate position, as illustrated in FIG. 1, the actuation rod member 16 protrudes outwardly from the top end of the barrel 14 in such a manner that the handle 22 is in a raised position relative to the barrel 14. On the other hand, the barrel 14 is in a lowered position within the housing 12 such that the cork-engaging portion 66 is disposed adjacent the lower end of the housing.

The screw 24 is so positioned that the tip 80 of the screw 24 does not extend through the hole defined by the annular collar 38. For safety reasons, the tip 80 of the screw 24 should not extend too close to or beyond the open end of the corkscrew 10 when the corkscrew 10 is in its ready-to-operate position and cannot do so in the preferred embodiment illustrated.

To commence operation, the corkscrew 10 is placed over the bottle 27 so that the tip 80 of the screw 24 points downwardly towards a substantially central point on the upper surface of the cork 26 which abuts the cork engaging portion 66. The handle 22 is then turned clockwise and is simultaneously pressed gently downward with the housing 12 being held against the bottle.

With reference to FIG. 3, it can be seen that the projection 58 is driven downwardly along the track 56 provided on the inner wall 50 of the barrel 14. This downward corkscrew motion drives the screw 24 downward to penetrate deeper into the cork and may eventually pass through the cork 26 depending on the length of the cork.

When the projection 58 reaches the lowest point of the track 56, one side of the projection, defining a first abutment surface, abuts the lower abutment surface, or stop 72, or on the barrel. The downward motion of the actuation rod member 16 relative to the barrel 14 will, therefore, be terminated. The handle 22 will now be in a lowered position relative to the barrel 14. In this position, the cork 26 is ready for extraction from the bottle. Instead of removing the cork 26 from the bottle by forcingly pulling the corkscrew form the bottle, as in the case for the conventional corkscrew, the user of the corkscrew 10 according to the present invention merely needs to continue the previous corkscrew motion in order to remove the cork 26 from the bottle.

Further clockwise movement of the handle 22 rotates the barrel, because of the abutment of the projection 58 with the stop 72. The barrel 14, together with the actuation rod member 16 moves upwardly with respect to the housing 12 (see FIG. 4). This reverse movement is realized by the presence of the oppositely threaded portion 52 provided on the outer wall 48 of the barrel 14 and the threaded portion 36 provided on the inner wall 30 of the housing 12 which is threadingly engaged to the threaded portion 52.

As the barrel 14 is driven upward while the housing 12 is still being held against the bottle, the screw 214 pulls the cork 26 from the bottle and carries it into the housing, as shown in FIG. 4.

To remove the cork 26 from the screw 24, the user now merely needs to start turning the handle 22 in the reverse direction, i.e. in the counterclockwise direction. When the handle 22 is turned in the counterclockwise direction, the projection 58 starts to move upwardly along the track 56 and the screw 24 moves upwardly relative to the barrel 14 as it unscrews from the cork, the cork being urged against the cork-engaging portion 66. The cork is released from, or almost released from the screw before the projection 58 reaches the end of the track 56.

When the projection 58 reaches the end of the track 56, its opposite side, defining a second abutment surface, abuts the upper abutment surface, or stop 74 (FIG. 1) of the barrel and upward movement of the actuation rod member 16 relative to the barrel 14 is stopped. Turning the handle 22 further in the counterclockwise direction starts driving the barrel 14 downward relative to the housing 12. The cork 26 is brought downward along the barrel by the cork-engaging portion 66.

As the barrel 14 travels to the lower position relative to the housing 12, the corkscrew 10 returns to a ready-to-operate position, expelling the cork 26 from the housing.

The corkscrew 10 hereinbefore described is advantageous in that it is relatively safe to use in comparison to the conventional corkscrews. Only general axially directing force and motion is applied throughout the entire course of operation. This greatly reduces the chance of accidental damages caused to a user.

Screwing into a cork and extracting it from a bottle is achieved by means of a single corkscrew motion which makes the corkscrew disclosed in the present invention very easy to operate.

What is claimed is:

1. A corkscrew comprising a housing having means for locating the housing over the mouth of a corked bottle, a screw member having a handle outside the housing and a screw within the housing, whereby rotation of the member in a first direction drives the screw into the cork in the bottle and the member axially into the housing, and first limiting means limiting said axial movement whereby continued rotation of the member in said first direction drives the cork into the housing and out of the bottle, wherein a barrel is screw-engaged in the housing and the limiting means is between the barrel and the member so that the cork is driven into the housing by axial movement of the barrel relative to the housing, means is provided in the housing for engaging the end of the cork, whereby rotation of the member in a second direction, opposite to the first direction, releases, or almost releases, the screw from the cork with axial movement of the member relative to the barrel and the housing, and second limiting means between the barrel and the member whereby continued rotation of the member in said second direction effects return axial movement of the barrel relative to the housing.

2. A corkscrew according to claim 1, wherein the means for engaging the end of the cork is provided on the barrel.

3. A corkscrew according to claim 1 or 2, wherein the first and second limiting means comprises abutment surfaces on the barrel and the member.

4. A corkscrew according to claim 3, wherein the first and second abutment means on the member are defined on a single projection on the member.

5. A corkscrew according to claim 4, wherein the barrel has a track for guiding the projection for engagement with the respective abutment means on the barrel.

6. A corkscrew according to claim 5, wherein the track is defined by right-handed single-star threads on the barrel.

7. A corkscrew according to claim 1, wherein the screw-engagement of the barrel in the housing is provided by left-handed two-start threads.

8. A corkscrew according to claim 6 or 7 wherein said threads are square threads, trapezoidal threads, or triangular threads.

9. A corkscrew according to claim 1, wherein an enlarged diameter portion is provided at an axial end of said housing to receive therein an open end portion of a bottle.

10. A corkscrew according to claim 9, wherein an annular collar portion is provided on the inner wall of said housing contiguous with said enlarged diameter portion to define a wall portion at the lower side thereof for seating on the top of a bottle.

11. A corkscrew according to claim 1 wherein said housing and barrel are made of plastic.

12. A corkscrew according to claim 1 wherein said screw is made of metal.

* * * * *